United States Patent [19]

Sekiya et al.

[11] 4,277,840

[45] Jul. 7, 1981

[54] ELECTRONIC TIMEPIECE

[75] Inventors: Fukuo Sekiya, Tokorozawa; Takashi Yamada, Sayama, both of Japan

[73] Assignee: Citizen Watch Co., Ltd., Tokyo, Japan

[21] Appl. No.: 965,892

[22] Filed: Dec. 4, 1978

[30] Foreign Application Priority Data

Dec. 27, 1977 [JP] Japan ..... 52-175181[U]

[51] Int. Cl.[3] ..... G04B 25/00; G04B 23/02; G04C 9/00

[52] U.S. Cl. ..... 368/71; 368/74; 368/187; 368/223

[58] Field of Search ..... 58/23 R, 90 R, 4 A; 368/71, 76, 79, 80, 82, 185, 187, 223, 224, 228, 232

[56] References Cited

U.S. PATENT DOCUMENTS

| | | | |
|---|---|---|---|
| 3,931,703 | 1/1976 | Scherrer et al. | 58/23 R |
| 3,945,191 | 3/1976 | Van Berkum | 58/4 A |
| 3,962,861 | 6/1976 | Protta et al. | 368/112 |
| 4,045,951 | 9/1977 | Tanaka | 58/50 R |

*Primary Examiner*—Vit W. Miska
*Attorney, Agent, or Firm*—Sherman & Shalloway

[57] ABSTRACT

An electronic timepiece having a first display unit which indicates the present time by means of digital values, and a second display unit of the hand type which displays the time set by an additional function such as alarm function by means of one or more hands.

10 Claims, 3 Drawing Figures

ELECTRONIC TIMEPIECE

BACKGROUND OF THE INVENTION

This invention relates to an electronic timepiece having a first digital display device consisting of an electronic/optical means for indicating the present time, and a second display device for indicating the time set by an additional function such as alarm function.

Electronic timepieces having a digital display device consisting of an electronic/optical means can be suitably equipped with various additional functions such as alarm function, stopwatch function and rest time-warning function, to provide the timepieces with varied operation and display modes. In prior art electronic timepieces having one or two or more such additional functions, the information related to the operation of the additional functions, such as set time when the additional function is an alarm function, can be usually displayed on the digital display device only when it is desired to confirm the information of such an additional function, putting aside the information of the main function of the timepiece for a while. The abovementioned display system has the advantage that reduced number of display digits are required for the display device, but also has the inconvenience that the information of additional functions are not always displayed. This inconvenience can be overcome if the digital display device is equipped with display digits for indicating information related to the main function of the timepiece as well as display digits for indicating information of the additional functions, resulting, however, in decreased recognizability because too many numerical figures are arrayed on the display surface.

SUMMARY OF THE INVENTION

It is an object of this invention to provide an electronic timepiece which is capable of simultaneously displaying information related to the main function of the timepiece and information related to additional functions, and which is equipped with a display device which displays the two types of information in an easy to see manner.

According to this invention, the problem of decreased recognizability resulting from the simultaneous display of two types of information on one display surface, can be solved by using a display device which has a digital display unit consisting of an electronic/optical means for indicating information related to the main function of the timepiece and a display unit of the hand type to separately indicate information related to the additional functions.

The display unit for displays information related to the additional functions by one or more hands, for example, by an hour hand and a minute hand. The display unit of the hand type displays information in analog form, making a clear distinction over the first display unit which displays the present time in the form of digital values, and is further precise enough to display information related to the additional functions.

The second display unit may be related to the first display unit. For instance, information related to the additional functions can be indicated on the first display unit only when an external operation member is manipulated. In other words, when the additional function is an alarm function, the time of the alarm function being set can be displayed on the display unit of the hand type and is also displayed on the first display unit in the form of digital values, thereby making it possible to set the alarm time to a precision superior to the display precision of the hand-type device.

BRIEF DESCRIPTION OF THE INVENTION

DESCRIPTION OF THE PREFERRED EMBODIMENTS

Figure 1:
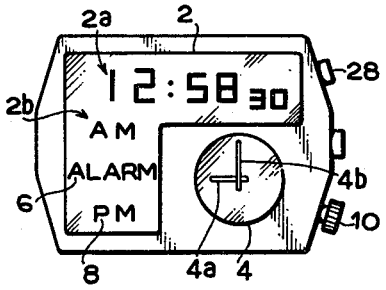
FIG. 1 is a front view of an electronic timepiece according to this invention.

An electronic timepiece shown in FIG. 1 has an alarm function as an additional function. Therefore, the display device has a first display unit 2 comprising an electronic/optical means for displaying the time, as the information of the main function, in the form of digital values, and a second display unit 4 of the hand type for displaying the set time of the alarm which is the information of the alarm function.

The first display unit 2 has a first display region **2*a* for indicating the present time in the form of digital values, and a second display region 2*b* which indicates characters "AM" when the present time is before noon and characters "PM" when the present time is after noon. Referring to FIG. 1, the first display unit 2** is displaying the present time of twelve fifty-eight and thirty seconds AM.

Figure 2:
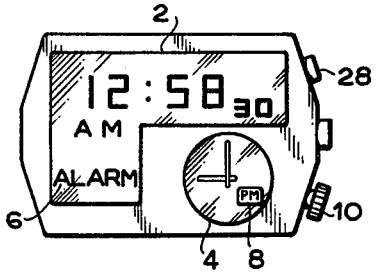
FIG. 2 is a front view of another electronic timepiece according to this invention.

The second display unit 4, in this case, has an hour hand **4*a* and a minute hand 4*b*, and is displaying the time at which is set for the alarm function, i.e., nine o'clock in FIG. 1. Preferably, the second display unit 4 will be equipped with a display region 6 for turning on the characters "ALARM" only when the alarm function is being selected, and a display region 8 for indicating whether the set time is before the noon or after the noon by means of characters "AM" or "PM". Referring to FIG. 2, the display region 8 for indicating whether the set time of the alarm function pertains to before or after the noon, is installed inside the second display unit 4**.

In FIGS. 1 and 2, reference numeral 10 denotes a crown for setting the present time and alarm time, and reference numeral 28 denotes a push button which will be pushed to select the alarm function or to release the alarm function. When the push button 28 is pushed to select the alarm function, the display "ALARM" appears on the display region 6.

Both the present time can be corrected and the set time of the alarm function can be changed by manipulating the crown 10. That is, the crown 10 is so constructed that it can be pulled out in two steps. When the crown is pulled out by two steps, the contents of alarm memory are displayed on the time-display positions of the first display unit 2 as will be mentioned later. In this state, the crown 10 can be rotated without affecting the contents of the alarm memory thereby to move the hands of the second display unit 4 in a purely mechanical manner, so that the positions of hands are brought into agreement with the contents of the alarm memory displayed on the first display unit 2. In the state in which the crown 10 is pulled out by one step, the first display unit 2 keeps displaying the present time. If the crown 10 is rotated under this state, the display of the second display unit 4 is corrected by electric signals produced in relation to the rotation of the crown. At the same time, the contents of the alarm memory that will be mentioned later are corrected by a quantity equal to the quantity of correcting the hands. Accordingly, if the contents of the alarm memory are once brought into agreement with the contents of the hand-type display device, the two contents are thereafter maintained in agreement with each other, whereby the second display unit 4 works as a device for displaying the alarm function.

Figure 3:
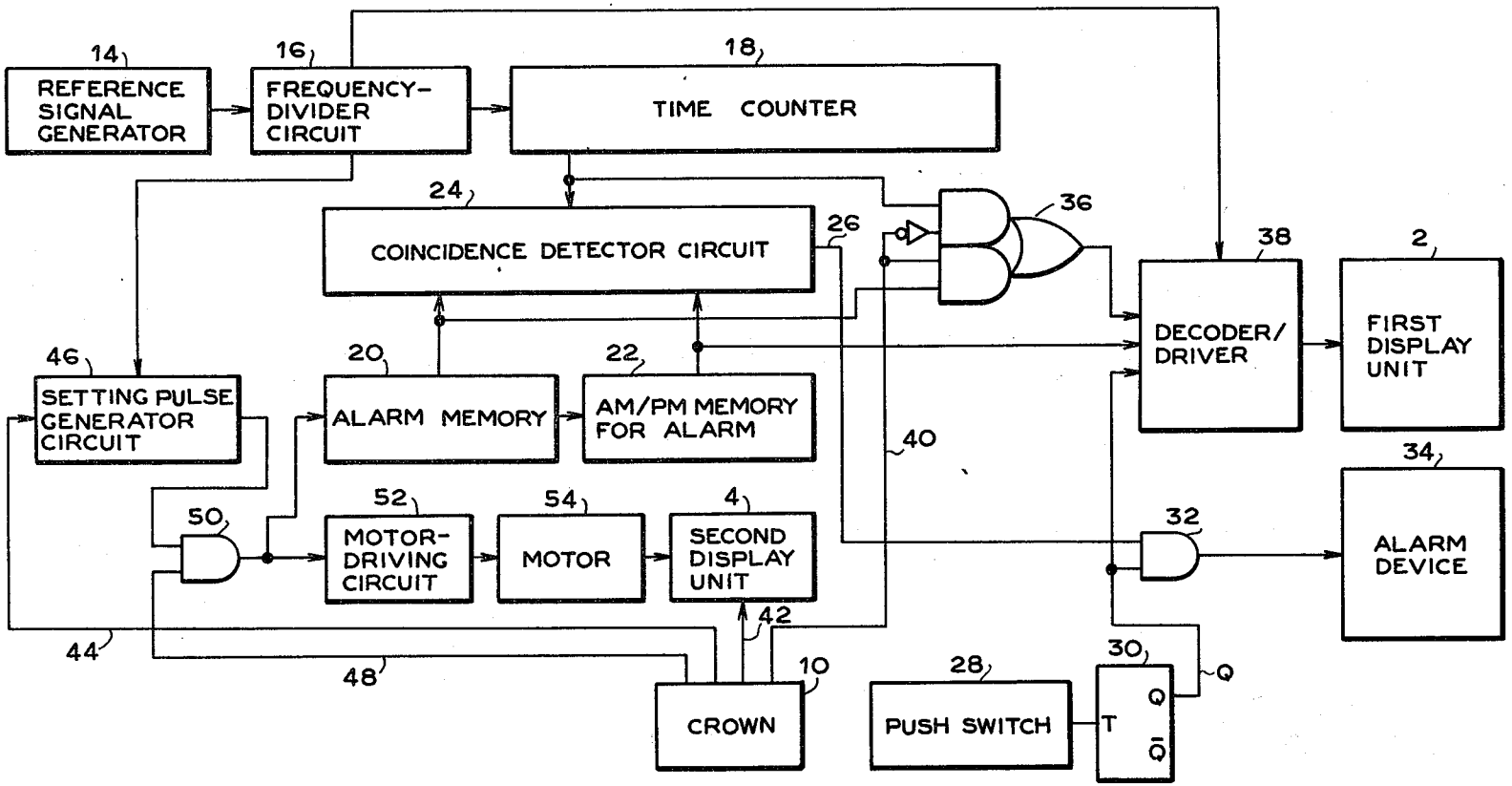
FIG. 3 is a block diagram showing major portions of the electronic timepiece shown in FIG. 1 or FIG. 2.

FIG. 3 is a block diagram of an electronic timepiece according to an embodiment of this invention, in which outputs of a reference signal generator 14 are divided by a frequency-divider circuit 16, and the frequency-divided signals are counted by a time counter 18 to measure the time. Reference numeral 20 denotes an alarm time memory, and 22 an AM/PM memory for the alarm. The contents of the two memories and the contents of the time counter 18 are compared by a coincidence detector circuit 24. When the contents are in agreement, a coincidence signal is produced on an alarm signal line 26. A push switch 28 is used to set and release the alarm function; the alarm function is set and released alternatingly for each operation of the push switch. An operation signal of the push switch 28 is fed to a toggle-type flip-flop 30 where the output is inverted for each operation of the switch 28. When the output is of a high level, denoted Q the alarm function is set, and when the signal Q is of a low level, the alarm function is released. The alarm signal line 26 and the high level output Q the flip-flop 30 are input into and AND-gate 30. The AND gate 30 provides an output to an alarm device 34 so that when a coincidence signal is produced on the line 26 while the signal Q is of the high level, alarming sound is produced by the alarm device 34. In a practice electric signals from the push switch 28 and the crown 10 will be produced through a chatter removing circuit. In FIG. 3, however, the chatter-removing circuit is not shown for the purpose of easy understanding of the present invention.

The contents of the time counter 18 and the alarm time memory 20 are fed to a decoder/driver 38 via a gate block 36 consisting of two AND gates and an OR gate, while the contents of the AM/PM memory 22 for the alarm and the flip-flop 30 are directly fed to the decoder/driver 38, to be displayed on the first display unit 2. When the output of the flip-flop 30 is of the high level Q, i.e., when the alarm function is being set the, characters "ALARM" 6 shown in FIGS. 1 and 2 are indicated, and when the output is of the low level, denoted Q the characters "ALARM" 6 are not indicated. With the crown 10 being pulled two steps, a signal on the line 40 acquires the high level. In this case, the contents of a alarm time memory 20 are fed to the decoder/driver 38 via the gate block 36. When the crown 10 is at the home position or in a state in which it is pulled by one step, the contents of the time counter 18 are fed to the decoder/driver 38.

A line 42 shows a mechanical connection; the rotational force of the crown 10 is transmitted to the hands only when the crown is pulled out by two steps. A pulse signal produced by rotating the crown 10 is fed onto a line 44, and is applied to a setting pulse generator circuit 46. Responsive to the signals fed through the line 44, the setting pulse generator circuit 46 produces setting pulses for changing the alarm setting time. A signal produced on a line 48 acquires the high level only when the crown 10 is pulled out one step, and is fed to one input terminal of an AND gate 50. Setting pulse signals have been applied to the other input terminal of the AND gate 50. Therefore, setting pulses produced by rotating the crown 10 only when it is pulled out by one step, and are fed to the alarm memories 20 and 22 to change the alarm setting time. An output of the AND gate 50 drives a second display unit 4 via a motordriving circuit 52 and a motor 54. In this embodiment, a minute hand of the second display unit 4 is so constructed that it is advanced by one minute for every half turn of the motor 54. Accordingly, the alarm time memory 20 and the display of the hand-type display device 4 are advanced by one minute per every output pulse of the AND gate 50. Thus, the two are self correcting being interlocked to each other when the crown is being pulled out one step. Therefore, if the display of the second display unit 4 is brought into agreement with the contents of the alarm memories 20 and 22 while the crown is pulled out by two steps, the two contents maintain an interlocked state in as much as the alarm time is corrected by pulling out the crown by one step. It is therefore possible to use the hand-type display device which is easy to look at, as a device for displaying the alarm time. Further, since the alarm time can be set by means of the crown, the setting operation can be easily performed in the same manner as in conventional mechanical timepieces.

Although FIG. 3 shows an embodiment in which the present time is displayed on the electronic/optical display unit 2 when the alarm time is being set, it is also possible to so construct the system that the alarm setting time can be displayed on the electronic/optical display unit 2. This latter system will give an advantage that the agreement of the positions of hands and the contents of the alarm memory can be easily confirmed.

Although the foregoing description has dealt with the case in which the additional function was an alarm function, it is of course within the scope of the present invention to use the hand-type display device for displaying additional functions such as stopwatch function and the like. In such a case, improvements can be expected with respect to easy recognizability.

What is claimed is:

1. An electronic timepiece comprising a first display unit including an electronic/optical means to display the present time in the form of digital values, and a second display unit for displaying the time maintained by an additional function, in which said second display unit is an analog display wherein (a) the analog display is interconnected with the electronic/optical display by means of an electronic circuit;

(b) the analog display becomes interlocked with the electronic interconnection circuit during the operation of the analog display;

(c) the analog display displays time in time units which are of the same magnitude as at least one of the time units displayed by the digital display; and (d) an external operating means is operable in one mode to adjust both the analog and digital displays and operable in an alternate mode to adjust either the analog display or the digital display, thereby allowing synchronization of the analog and digital displays.

2. The electronic timepiece according to claim 1 wherein the interconnection circuit includes digital memory.

3. The device according to claim 1 wherein the analog display is a timepiece-associated alarm display which is interlocked with a digital alarm memory means, the digital alarm memory means being operative to provide an alarm signal when time stored in the digital alarm memory coincides with an electronic time signal.

4. The timepiece of claim 3 wherein the electronic time signal also provides the digital values for the electronic/optical means to display the present time.

5. An electronic timepiece according to claim 4 in which the interconnection circuit acts to cause the second display unit to correct any deviation between the value indicated by the analog display and values which are stored in the electronic circuit.

6. The electronic timepiece of claim 1 wherein the crown means is a single crown which is moved to one position to operate in the first mode and is moved to a second position to operate in the alternate mode.

7. An electronic timepiece having an alarm comprising a reference signal generator, a frequency-divider circuit for dividing the frequency of output signals of a reference signal generator, a time counter for measuring the time by counting the output pulses of the frequency-divider circuit, a decoder/driver for decoding the output signals of the time counter, a first display unit composed of an electronic/optical means to display the time measured by the time counter in the form of a digital quantity, wherein a second display unit is provided for displaying information independent of that displayed by the first display unit, and the second display unit is an analog display, further comprising a means for changing the information displayed on the second display unit, and an alarm time memory circuit which stores the information displayed on the second display unit, wherein said changing means causes the alarm memory circuit to become synchronized with the analog display so that the analog display correctly indicates the time stored in the alarm memory, and said alarm memory provides a signal to a coincidence detector to cause said alarm to operate.

8. The electronic timepiece of claim 7 in which a coincidence detector circuit compares the time stored in the alarm time memory with the time measured by the time counter so as to produce a coincidence signal when the two times are in agreement, and alarm means to produce an alarm upon the reception of the coincidence signal.

9. The electronic timepiece according to claim 8 wherein there is provided a means to distinguish whether the time stored in the alarm memory is AM or PM.

10. An electronic timepiece according to claim 5 or 8 wherein the electronic timepiece is equipped with a crown for correcting the time displayed on the first display unit and the time displayed in the second display unit.

* * * * *